US006360748B1

(12) United States Patent
Chapman

(10) Patent No.: US 6,360,748 B1
(45) Date of Patent: Mar. 26, 2002

(54) APPARATUS AND METHOD FOR SAFELY MAINTAINING AN EXTENDED RESTRAINING HOLD ON A PERSON

(75) Inventor: Bruce Chapman, Gardiner, NY (US)

(73) Assignee: Handle With Care, Inc., Gardiner, NY (US)

( * ) Notice: Subject to any disclaimer, the term of this patent is extended or adjusted under 35 U.S.C. 154(b) by 0 days.

(21) Appl. No.: 09/716,031

(22) Filed: Nov. 17, 2000

Related U.S. Application Data

(63) Continuation-in-part of application No. 09/442,709, filed on Nov. 18, 1998.

(51) Int. Cl.[7] ..... A61B 19/00

(52) U.S. Cl. ..... 128/869; 128/878; 128/881; 128/892

(58) Field of Search ..... 128/869, 845, 128/846, 877, 878, 881, 892, 893; 602/20, 21, 22

(56) References Cited

U.S. PATENT DOCUMENTS

| | | | | |
|---|---|---|---|---|
| 2,211,203 A | * | 8/1940 | Goldman | 128/881 |
| 3,268,912 A | * | 8/1966 | Whelan | 128/892 |
| 3,322,118 A | * | 5/1967 | Sotherlin | 128/892 |
| 3,937,218 A | * | 2/1976 | Gaylord | 128/892 |
| 4,150,442 A | * | 4/1979 | Boone | 128/892 |

* cited by examiner

*Primary Examiner*—Michael A. Brown
(74) *Attorney, Agent, or Firm*—Edward Etkin, Esq.

(57) ABSTRACT

An apparatus and method for assisting a first person in maintaining a safe restraining hold on a second person for extended period of time without danger of positional asphyxiation is disclosed. The apparatus comprises a first resilient pad with a receiving channel for receiving the first person's elbow and bottom flat surface having an extruded area positioned and configured to releasably attach to an additional stabilizing pad underneath so that the position of the apparatus may be optionally elevated above the floor surface. The first person initiates the restraining hold by manipulating the second person into a face-down prone position onto the floor surface, such that the first person is disposed along and above the second person. The first person completes the restraining hold when the first person's weight is distributed between the first person's knees and the first person's elbow such that the first persons elbow is proximal to a corresponding arm of the second person. The apparatus is then applied and positioned by a third person such that the first person's elbow is retained within the receiving channel. The pressure of the elbow in the channel is sufficient to form a releasable vacuum seal between the first resilient pad and the additional resilient pad if it is present. The first person is thus comfortably elevated over the second person during extended application of the hold and danger of positional asphyxiation is thereby eliminated.

5 Claims, 9 Drawing Sheets

APPARATUS AND METHOD FOR SAFELY MAINTAINING AN EXTENDED RESTRAINING HOLD ON A PERSON

REFERENCE TO PREVIOUSLY FILED APPLICATIONS

The present patent application is a continuation-in-part of a previously filed commonly assigned U.S. patent application Ser. No.: 09/442,709, entitled "Apparatus and Method for Safely Maintaining a Restraining Hold on a Person" filed on Nov. 18, 1998.

BACKGROUND OF THE INVENTION

The present invention is directed to an apparatus and method for assisting a first person in maintaining a restraining hold on a second person for extended periods of time.

There are many thousands of human service and law enforcement agencies is and facilities that provide care and supervision to aggressive, suicidal, and emotionally disturbed persons (hereinafter commonly referred to as "EDPs"). The staff and officers working in these agencies regularly come into physical contact with the EDPs through the use of physical subduing or restraint holds when the EDP becomes aggressive. Although there are many types of well-known physical subduing holds, the safest and most advantageous physical subduing hold is a Primary Restraint Technique (PRT).

The PRT is an advantageous system of maneuvers that was developed by Bruce Chapman, a professional in the field of EDP care and supervision, from years of experience with subduing and restraining EDPs in a variety of environments. The PRT is a single person restraint that is applied from behind by engaging both arms of the EDP simultaneously or from the side by engaging one arm first followed by the other. The staff member engages or threads his arms through EDP's arms so that the EDP's elbows are underneath the staff member's armpits, his chest held closely against the EDP's back, hands overlapping or side by side with the palms flat or on edge against the EDP's back, such that the staff member's wrists and fingertips are pointed towards the EDP's head. The act of turning the fingertips and wrists straight up in this configuration has the effect of making the PRT a mechanically correct "skeletal lock" and this distinguishes it from any other wrestling or subduing hold. The PRT can be further reinforced or stabilized by taking hold of clothing worn by the EDP but, even with closed fists (with or without clothing), the wrists must but be turned straight up in order to take full advantage of this passive "locking" effect. Essentially, the staff member's upper and lower arm bones passively lock the upper and lower arm bones of the EDP without the use of muscularity or strength on the part of the staff member. The PRT cannot be broken with strength. It is this mechanical advantage that allows persons of modest size and strength to safely subdue stronger and larger EDPs than otherwise possible with any other passive subduing hold.

The PRT is implemented as a standing restraint, making it useful to control an EDP on their feet. Thus the PRT is particularly useful as a single person "restrain and escort" technique. However, there are also occasions when an EDP may continue to struggle after the PRT is applied, necessitating (for safety reasons) a "takedown" by a staff member to the floor. A takedown method was devised to complement the PRT in order to eliminate virtually all of kinetic energy when the EDP is moved rearward into what is herein described as a "settle position". However, because the settle position is not particularly stable, a further technique was devised of turning the head of the EDP 180 degrees face down to a prone or what is described as a "neutral position". The neutral position eliminates virtually all of kinetic energy and impact forces that may be exerted by the staff member on the EDP as the EDP is turned face down.

The neutral position offers the maximum amount of control to the staff member due to the specific angle of the lower body of the staff member angled at an approximate 45 degree angle to the lower body of the EDP and with his hip slightly below and pressed tightly against the hip of an actively combatant EDPs. Although many EDPs regain composure relatively quickly, others can remain in a combative state for extended period of time. When the EDPs remain agitated for extended period of time (sometimes up to thirty minutes or longer) regardless of the restraint method used, the EDP may be exposed to what is described in the medical literature as positional asphyxiation resulting from accidental chest compression. Staff members of all sizes and weights work in various care agencies, subduing EDPs of all sizes and weights who are of varying degrees of physical health. Naturally, the problem of chest compression is exacerbated as the difference in size between the staff member and the EDP becomes greater in favor of the staff member, as is often the case when adults restrain children and juveniles, and the longer the restraint is maintained. The combination of chest compression and fatigue on the part of the EDP's of all ages and sizes can be fatal and it is an increasing concern in the human service industry.

The PRT in the neutral position is the only prone-type restraint technique that enables staff members to eliminate virtually all of their weight from an EDP's chest, thereby rendering positional asphyxiation virtually impossible. Maintenance of the neutral position is made possible using the "tripod modification" technique. The tripod modification is a method whereby the staff member shifts their entire upper body weight to an "outside elbow" and to a lessor extent one or both knees. It is the ability to eliminate the entire body weight from the EDP that distinguishes the PRT in the neutral position from any other prone restraint or subduing hold method. Despite this feature, the size of the EDP, the surface of the floor covering in the location of the engagement of the PRT neutral position, the duration of the prone restraint and other factors can make it difficult to maintain a tripod modification.

Thus, it would be desirable to provide an apparatus or method to assist a staff member in maintaining the PRT in the tripod modification for an extended period of time, thereby reducing the danger of positional asphyxiation of the EDP.

SUMMARY OF THE INVENTION

The apparatus and method of use thereof of the present invention remedies the problems associated with extended restraining holds and encourages and reminds staff members to maintain a tripod modification throughout the entire restraint procedure. In brief summary, the apparatus protects, cradles, stabilizes and elevates the staff member's outside elbow, enabling the staff member to maintain tripod modification comfortably, for an extended period of time with EDP's of various sizes and with greatly reduced risk and discomfort to the EDP.

The Primary Restraint Technique (hereinafter "PRT") is an advantageous modular single person restraint that is applied by an EDP care professional (hereinafter "staff member") to an EDP from behind by engaging both arms simultaneously or from the side by engaging one arm followed by the other. The maneuvers involved in implementing the PRT are illustrated in FIGS. 1A to 1G. One of the advantages of the PRT is that it utilizes a "modular" approach. The PRT includes separate techniques, or "modules" may be implemented by the staff member to accomplish different objectives with respect to the EDP. The modules include an initial "standing restraint" a "takedown", a "neutral position", and a "tripod modification".

In the initial "standing restraint" module of the PRT a staff member approaches an EDP from behind. The staff member engages or threads his arms through EDP's arms so that the elbows are underneath the staff member's armpits, the staff member's chest held closely against the EDP back, hands overlapping with the palms flat against the EDP back, such that the staff member's wrists and fingertips are pointed towards the EDP head. The act, by the staff member, of turning the fingertips and wrists straight up in this configuration has the effect of making the PRT a mechanically correct "skeletal lock" and this distinguishes it from any other wrestling or subduing hold. The PRT cannot be broken with strength. It is this mechanical advantage that allows persons of modest size and strength to safely subdue stronger and larger EDP than otherwise possible with any other passive subduing hold.

The initial standing restraint module of the PRT is useful to control an EDP on their feet. Thus, the PRT is particularly useful as a single person "restrain and escort" technique. However, there are also occasions when an EDP may continue to struggle after the PRT is applied, necessitating (for safety reasons) a takedown of the EDP by the staff member to the floor into the "neutral position" where the struggling EDP may be better restrained. A "takedown" module was devised to complement the PRT in order to eliminate virtually all of kinetic energy when the EDP is moved to the neutral position.

The standard takedown module is initiated after the standing restraint when the staff member takes a deep step back, lowering his or her center of gravity and drawing the EDP off-balance. During this maneuver, the staff member maintains his or her palms against the EDP back to support the EDP weight. The staff member then lowers his or her (deep stepping) knee to the floor followed by the other knee, slowly staging the EDP descent to a sitting position. The staff member's move to a kneeling position while maintaining the EDP in the sitting position is known as the "settle position". There are also two alternative takedown modules (the "A" Frame and "High Speed "A" Frame takedowns—not depicted) that involve simultaneously stepping or hopping with both legs and simultaneously lowering both knees to the settle position. However, because the settle position is not particularly stable, a further technique was devised for enabling the staff member to shift the EDP face down to the more stable, prone, "neutral position". To place the EDP in the neutral position from the settle position, the staff member 10 pivots his or her knee to gently initiate the move and straightens the other leg to complete a turn of the EDP 180 degrees into the "neutral position". This manner of turning to the neutral position eliminates virtually all of kinetic energy and impact forces that may be exerted by the staff member on the EDP as the EDP is turned face down.

The neutral position offers the maximum amount of control, to the staff member, of actively combatant EDP. Although many EDPs regain composure relatively quickly, others can remain in a combative state for extended period of time. When the EDP remains agitated for an extended period of time regardless of the restraint method used, the EDP may be exposed to what is described in the medical literature as positional asphyxiation. Staff members of all sizes and weights work in various care agencies, subduing EDPs of all sizes and weights who are of varying degrees of physical health. Naturally, the problem of chest compression is exacerbated as the difference in size between the staff member and the EDP becomes greater in favor of the staff member, and the longer the restraint is maintained. The combination of chest compression and fatigue on the part of the EDP 12 can be fatal and it is an increasing concern in the human service industry.

The PRT in the neutral position is the only prone-type restraint technique that enables a staff member to eliminate virtually all of their weight from the EDP's chest, thereby rendering positional asphyxiation virtually impossible. Maintenance of the neutral position is made possible using a "tripod modification" PRT module. To achieve tripod modification, the staff member shifts their entire upper body weight to the outside elbow while maintaining some support with both knees as necessary. It is the ability to eliminate the entire body weight of the staff member from the EDP that distinguishes the PRT in the neutral position from any other prone restraint or subduing hold method. Despite the advantages of the tripod modification, the size of the EDP, the surface of the floor covering in the location of the engagement of the PRT neutral position, the physical size and condition of the staff member, the duration of the prone restraint and other factors can make maintenance of the tripod modification by the staff member a difficult task.

The apparatus of the present invention—a tripod support stand—operatively assists the staff member in comfortably maintaining the tripod modification module over the EDP for an extended period of time, while eliminating the danger of positional asphyxiation. Furthermore, the inventive apparatus enables a smaller staff member to apply and maintain the tripod modification over a larger EDP.

In a first embodiment of the present invention, a tripod support stand includes a first resilient pad of a predetermined thickness having a top surface with a receiving channel for receiving the staff member's elbow disposed thereon, and a substantially flat bottom surface having a centrally positioned extruded area, generally corresponding to the position of the receiving channel, and an optional second resilient pad having, on its upper surface, a receiving indentation generally shaped and postioned to align with, and receive the extruded area of the first resilient pad. When the first and second resilient pads come into contact and pressure is applied into the receiving channel by the staff member's elbow, the extruded area enters the receiving indentation and creates a vacuum seal releasably attaching the first resilient pad to the second resilient pad. After utilization, the first and second resilient pads may then be detached from one another with relative ease by pulling them apart to break the vacuum seal between the extruded area and the receiving indentation.

A bottom area of the second resilient pad may optionally be configured to provide limited movement on contact with a floor surface to facilitate potentially necessary movement of the staff member during utilization of the tripod stand. The tripod support stand also advantageously extends the reach of the staff member's elbow so that contact with the floor surface may be accomplished via the first resilient pad (alone or in combination with the second resilient pad), and so that the staff member may be comfortably elevated over the EDP.

In another embodiment of the invention, the second resilient pad is identical to the first resilient pad and the tripod stand is utilized in a similar manner to the previous embodiment except that the receiving channel of the second resilient pad is aligned with the extruded area of the first resilient pad to form the vacuum seal as the staff member's elbow contacts and applies pressure to the receiving channel of the first resilient pad.

The method of utilization of the tripod support stand is very simple. When the staff member places the EDP into the tripod modification position, a second staff member (not shown) places the tripod support stand consisting of the first resilient pad under the elbow of the staff member such that the elbow enters the receiving channel. If necessary, the second staff member adds the second resilient pad under the first one to elevate the position of the tripod support stand, and thus the elbow, above the floor surface.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote corresponding or similar elements throughout the various figures.

DESCRIPTION OF THE PREFERRED EMBODIMENTS

The present invention relates to an advantageous apparatus and method for assisting a first person in maintaining a retraining hold, such as a Primary Restraint Technique, on a second person for an extended period of time, while reducing a danger of positional asphyxiation to the second person.

It should be understood that while the present invention refers to Emotionally Disturbed Persons (hereinafter "EDPs") and Staff Members, the inventive techniques and apparatus may be applied in virtually any situation where a first person applies a restraining hold to another person. Thus, the present invention is applicable in law enforcement, hospitals, mental health care facilities, drug and alcohol rehabilitation centers, etc.

The Primary Restraint Technique (hereinafter "PRT") is an advantageous modular single person restraint that is applied by an EDP care professional (hereinafter "staff member") to an EDP from behind. The maneuvers involved in implementing the PRT are illustrated in FIGS. 1A to 1G. One of the advantages of the PRT is that it utilizes a "modular" approach. The PRT includes separate techniques, or "modules" may be implemented by the staff member to accomplish different objectives with respect to the EDP. The modules include an initial "standing restraint" shown in FIGS. 1A and 1B, a "takedown" shown in FIGS. 1C to 1F, a "neutral position" shown in FIG. 1G and a "tripod modification" shown in FIG. 2.

Referring now to FIG. 1, the initial "standing restraint" module of the PRT is illustrated. Initially, a staff member 10 approaches an EDP 12 from behind. The staff member 10 engages or threads his arms 14 through EDP's arms 13 so that the EDP 12 elbows are underneath the staff member 10 armpits, the staff member 10 chest held closely against the EDP 12 back, hands overlapping with the palms flat against the EDP 12 back, such that the staff member 10 wrists and fingertips are pointed towards the EDP 12 head. The act, by the staff member 10, of turning the fingertips and wrists 15 straight up in this configuration has the effect of making the PRT a mechanically correct "skeletal lock" and this distinguishes it from any other wrestling or subduing hold. The skeletal lock is best illustrated with reference to FIG. 1B where an overhead view of the standing restraint is shown. It is essentially the staff member 10 upper and lower arm bones "locking" the upper and lower arm bones of the EDP 12 without the use of muscularity or strength on the part of the staff member 10. The PRT cannot be broken with strength. It is this mechanical advantage that allows persons of modest size and strength to safely subdue stronger and larger EDP 10 than otherwise possible with any other passive subduing hold.

Figure 1A:
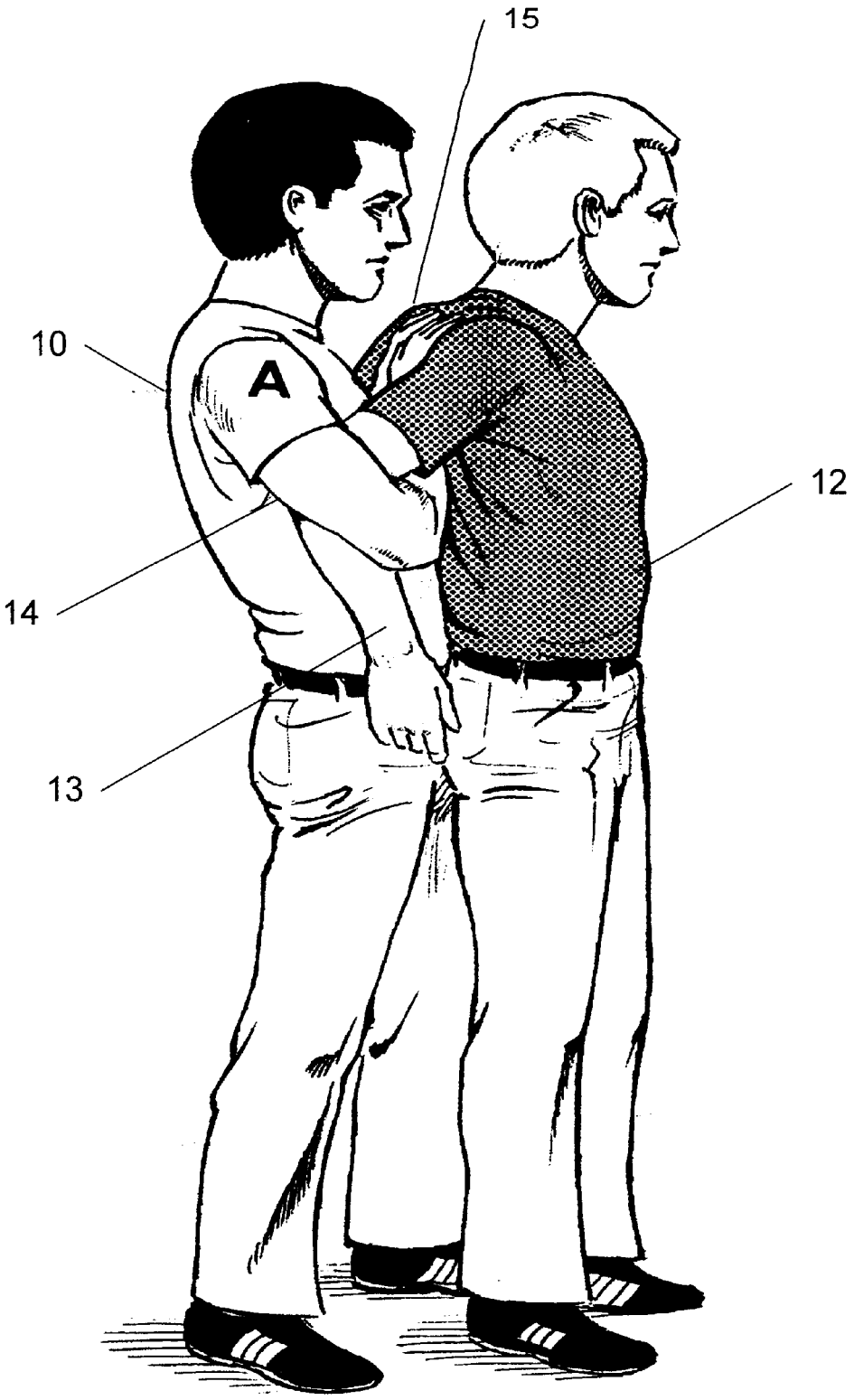
FIG. 1A shows an initial position of a Primary Restraint Technique of the present invention.
Figure 1B:
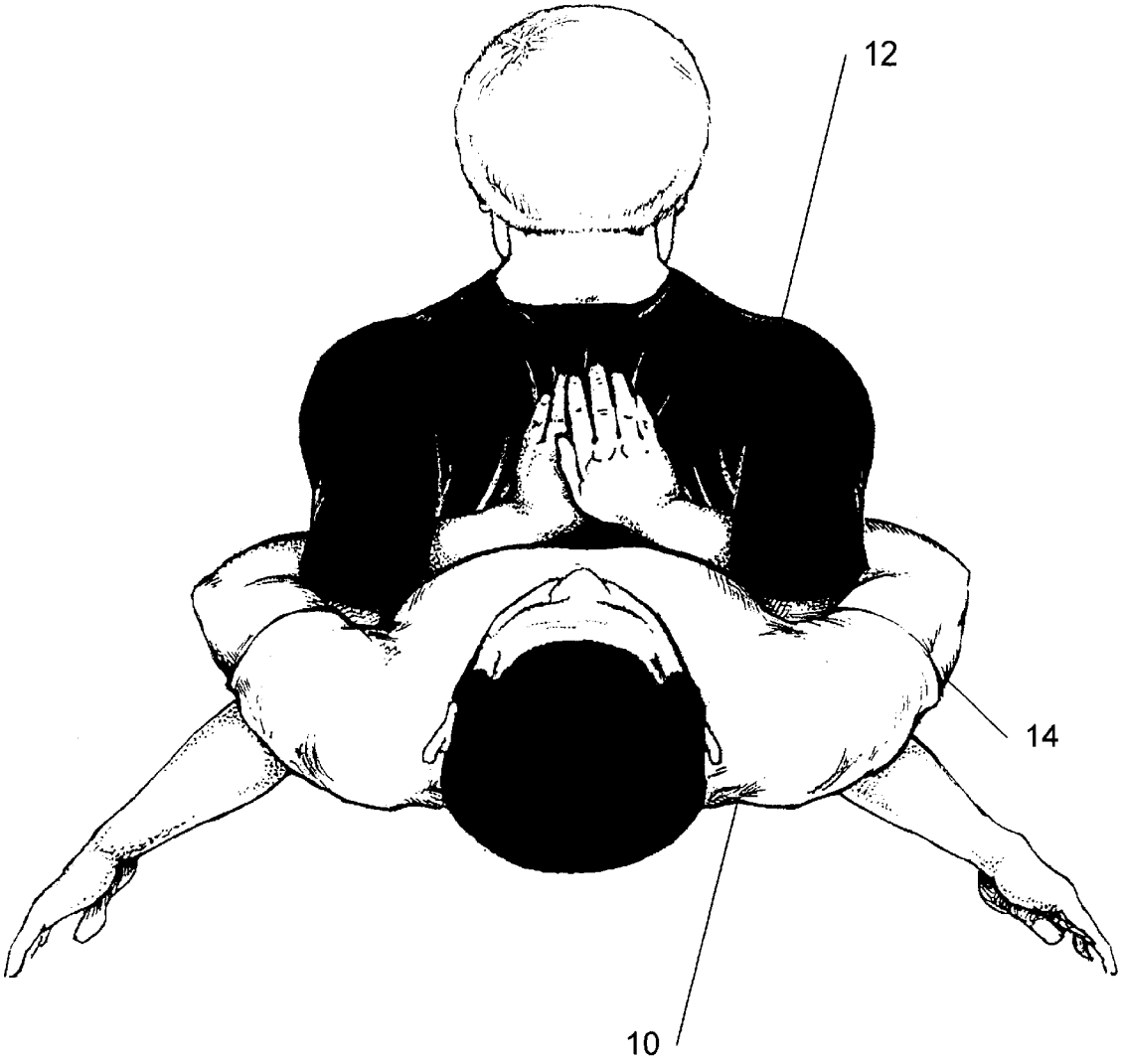
FIGS. 1B to 1F show steps for implementing modules of the Primary Restraint Technique of the present invention.
Figure 1C:
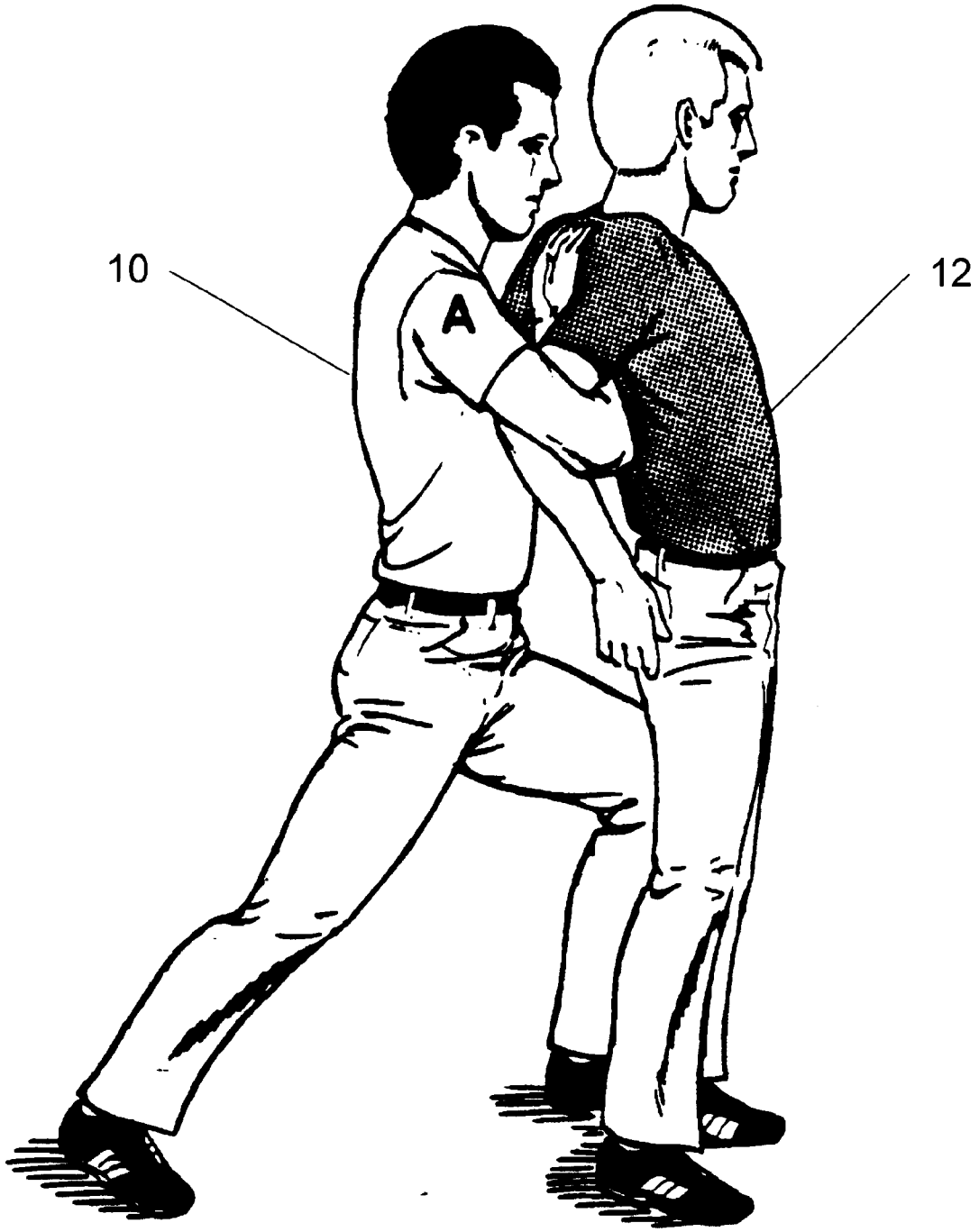
Figure 1D:
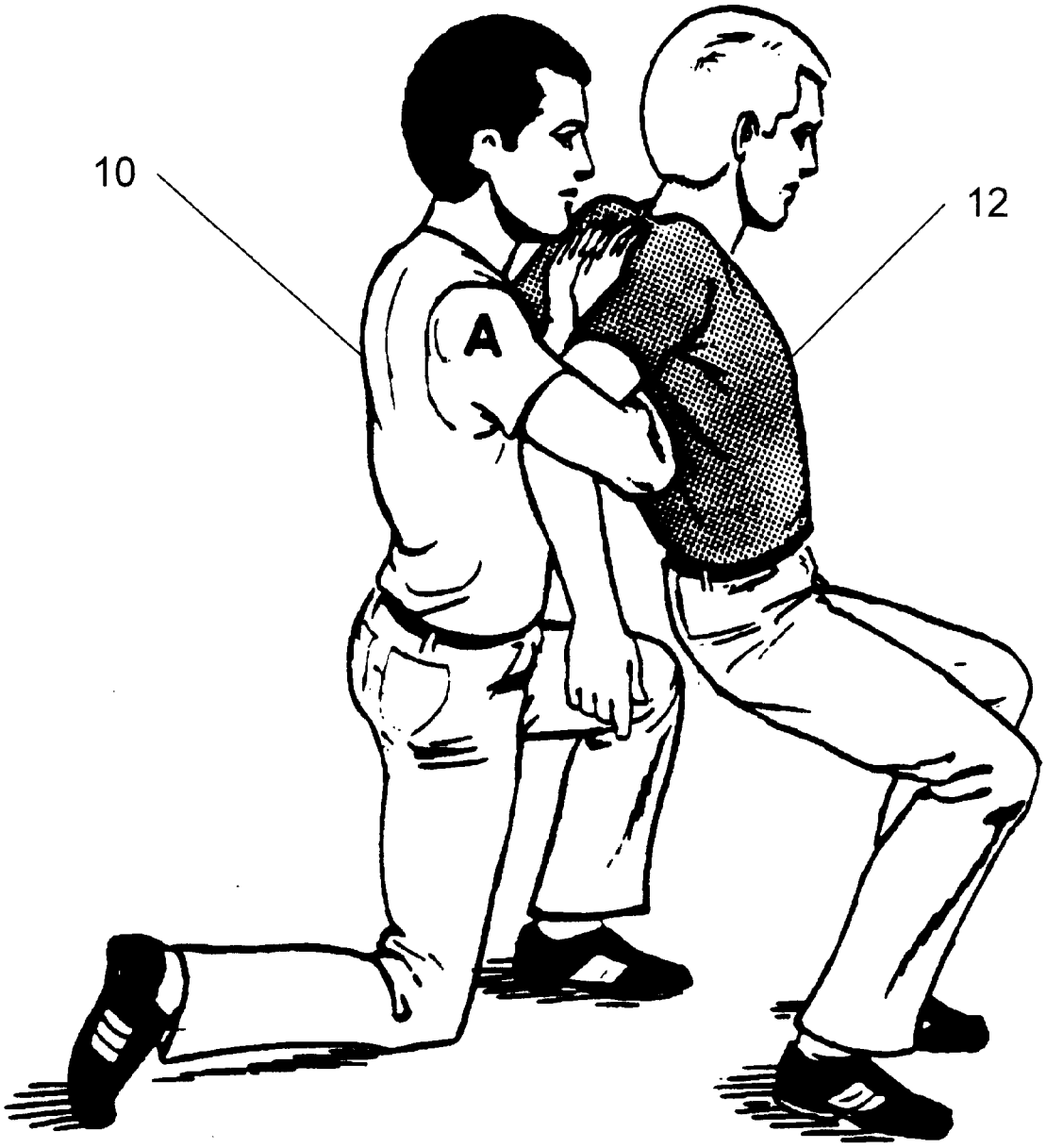
Figure 1E:
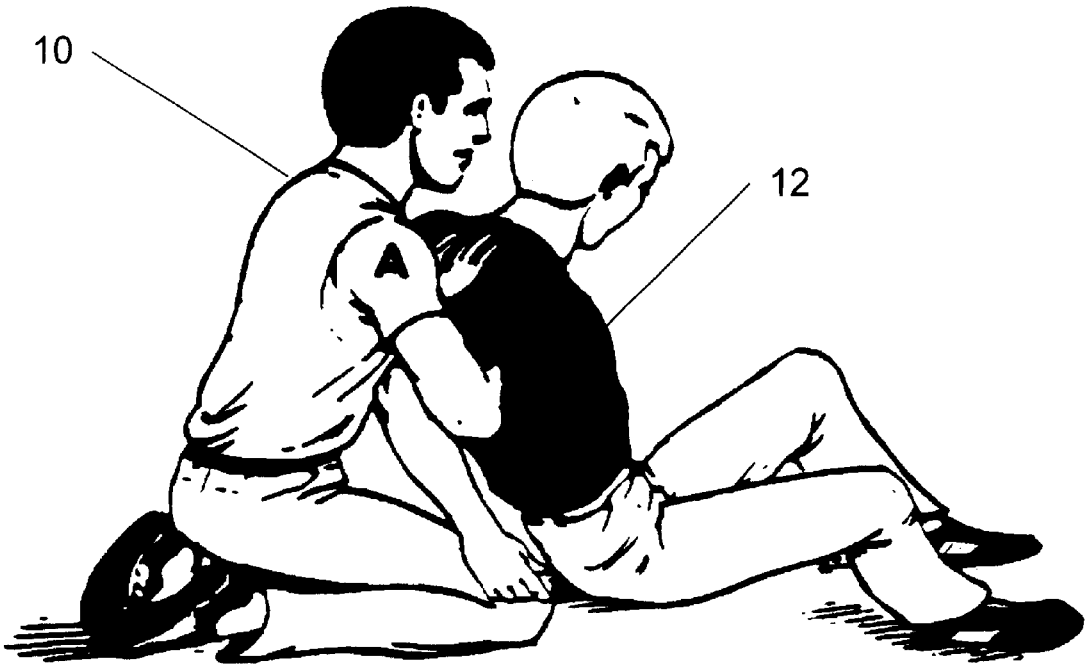
Figure 1F:
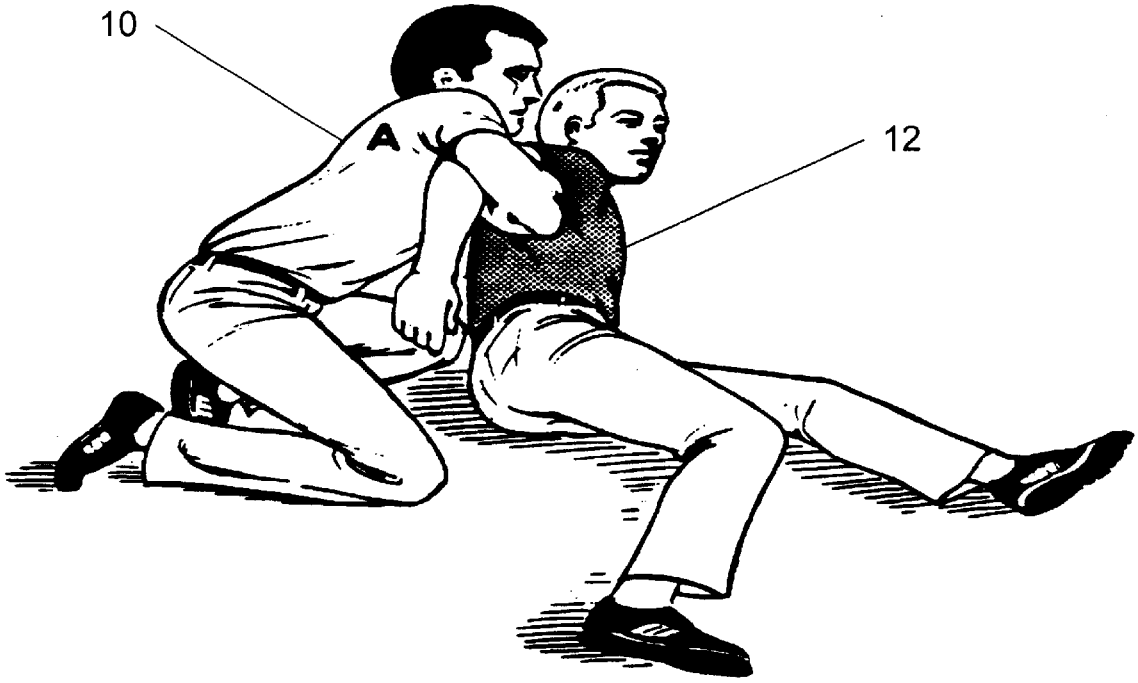
Figure 2:
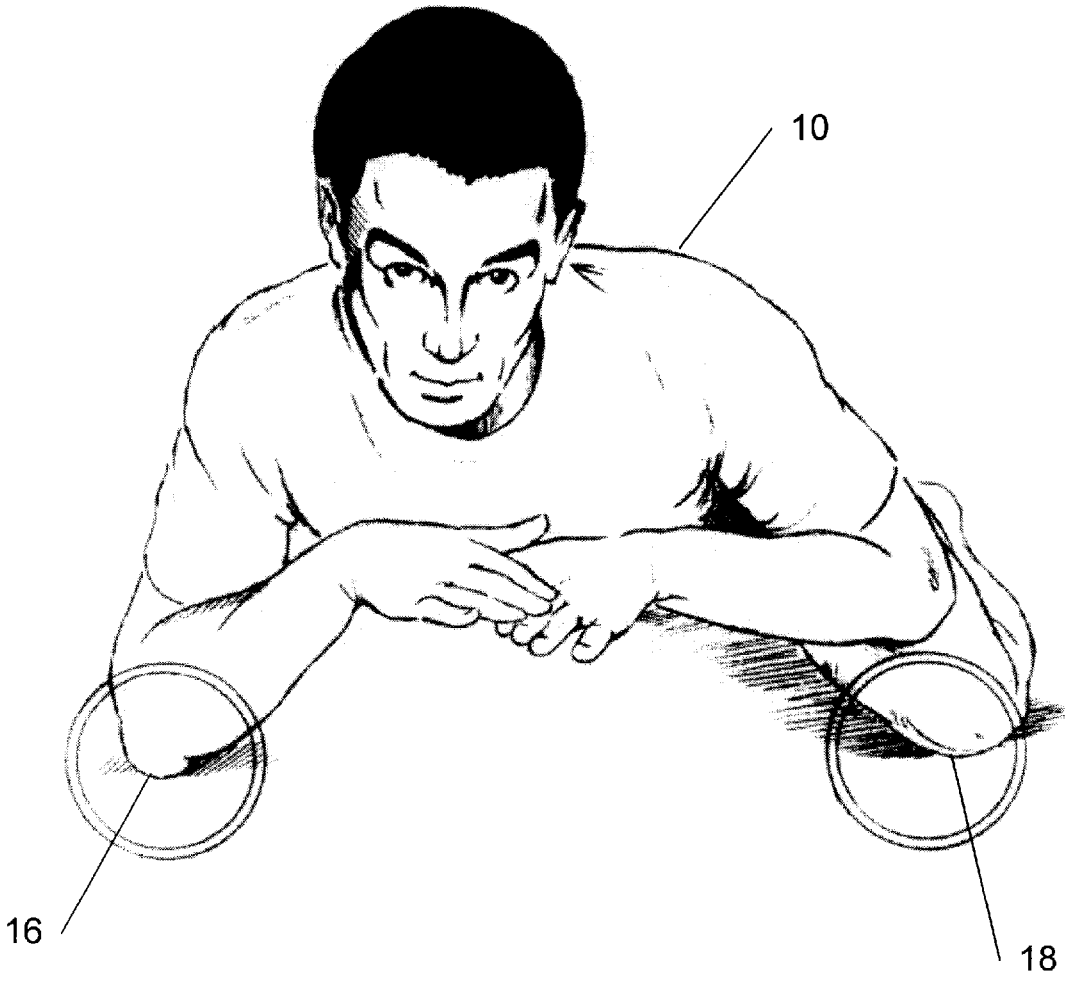
FIG. 2 shows a Tripod Modification of the Neutral Position of FIG. 1G.

The initial standing restraint module of the PRT is useful to control an EDP 12 on their feet. Thus, the PRT is particularly useful as a single person "restrain and escort" technique. However, there are also occasions when an EDP 12 may continue to struggle after the PRT is applied, necessitating (for safety reasons) a takedown of the EDP 12 by the staff member 10 to the floor into a "settle position" where the struggling EDP 12 may be better restrained. A "takedown" module was devised to complement the PRT in order to eliminate virtually all of kinetic energy when the EDP is moved to the settle position. Referring now to FIGS. 1C to 1E, the steps necessary to perform the takedown module and bring the EDP into the settle position are illustrated. It should be initially noted that the takedown module must be initiated from the standing restrain module of the PRT. Referring to FIG. 1C, the takedown module is initiated when the staff member 12 takes a step back, lowering his or her center of gravity and drawing the EDP 12 off-balance. During this maneuver, the staff member 10 maintains his or her palms against the EDP 12 back to support the EDP 12 weight. Referring to FIG. 1D, the staff member 10 lowers his or her knee to the floor slowly staging the EDP 12 descent to a sitting position. Referring to FIG. 1E, the staff member 10 moves to a kneeling position while maintaining the EDP 12 in the sitting position. Referring to FIG. 1F, the staff member 10 pivots his or her knee and gently turns the EDP 12 180 degrees into the settle position.

Figure 1G:
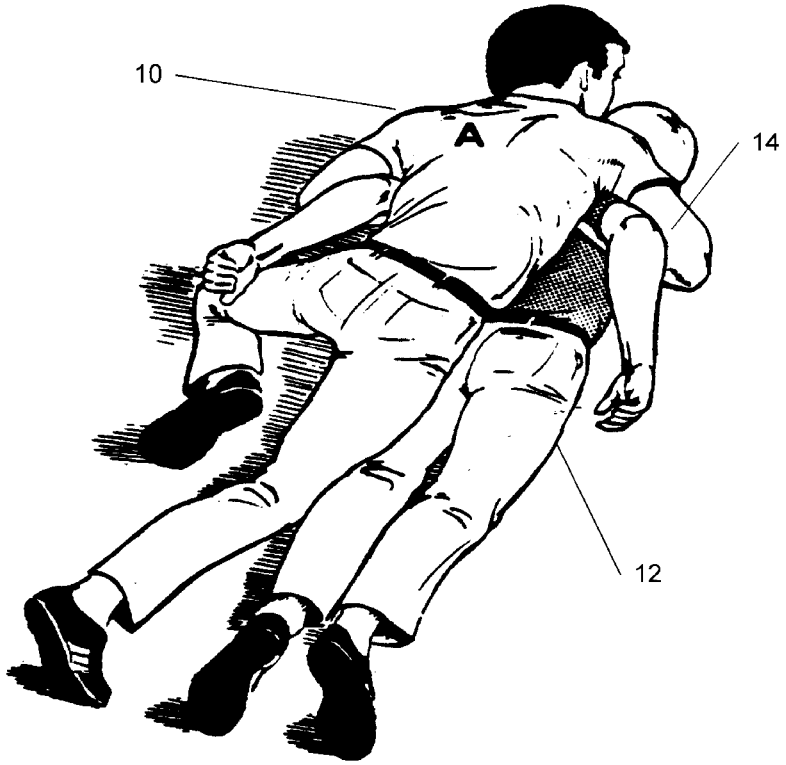
FIG. 1G shows a Neutral Position at the conclusion of the Primary Restraint Technique of FIGS. 1A to 1G.

However, because the settle position is not particularly stable, a further technique was devised for enabling the staff member 10 to shift the EDP 12 face down to a more stable, prone, "neutral position". Referring to FIG. 1G, the neutral position is illustrated. The neutral position eliminates virtually all of kinetic energy and impact forces that may be exerted by the staff member 10 on the EDP 12 as the EDP 12 is turned face down.

The neutral position offers the maximum amount of control, to the staff member 10, of actively combatant EDP 12. Although many EDPs regain composure relatively quickly, others can remain in a combative state for extended period of time. When the EDP 12 remains agitated for an extended period of time (sometimes up to thirty minutes or longer) regardless of the restraint method used, the EDP 12 may be exposed to what is described in the medical literature as positional asphyxiation. Staff members of all sizes and weights work in various care agencies, subduing EDPs of all sizes and weights who are of varying degrees of physical health. Naturally, the problem of chest compression is exacerbated as the difference in size between the staff member 10 and the EDP 12 becomes greater in favor of the staff member 10, and the longer the restraint is maintained. The combination of chest compression and fatigue on the part of the EDP 12 can be fatal and it is an increasing concern in the human service industry.

The PRT in the neutral position is the only prone-type restraint technique that enables a staff member 10 to eliminate virtually all of their weight from the EDP 12 chest, thereby rendering positional asphyxiation virtually impossible. Maintenance of the neutral position is made possible using a "tripod modification" PRT module illustrated in FIG. 2. To achieve tripod modification, the staff member 10 shifts their entire upper body weight to an outside elbow 16 while maintaining support with a knee 18. It is the ability to eliminate the entire body weight of the staff member 10 from the EDP 12 that distinguishes the PRT in the neutral position from any other prone restraint or subduing hold method. Despite the advantages of the tripod modification, the size of the EDP 12, the surface of the floor covering in the location of the engagement of the PRT neutral position, the physical size and condition of the staff member 10, the duration of the prone restraint and other factors can make maintenance of the tripod modification by the staff member 10 a difficult task.

The apparatus of the present invention operatively assists the staff member 10 in comfortably maintaining the tripod modification module over the EDP 12 for an extended period of time, while eliminating the danger of positional asphyxiation. Furthermore, the inventive apparatus enables a smaller staff member 12 to apply and maintain the tripod modification over a larger EDP 12. It should be understood that embodiment of the present invention described below and illustrated in FIGS. 3A to 3C are shown by way of example only and relative sizes of various components, and composition of materials of the inventive apparatus may be varied as a matter of design choice without departing from the spirit of the present invention.

Figure 3A:
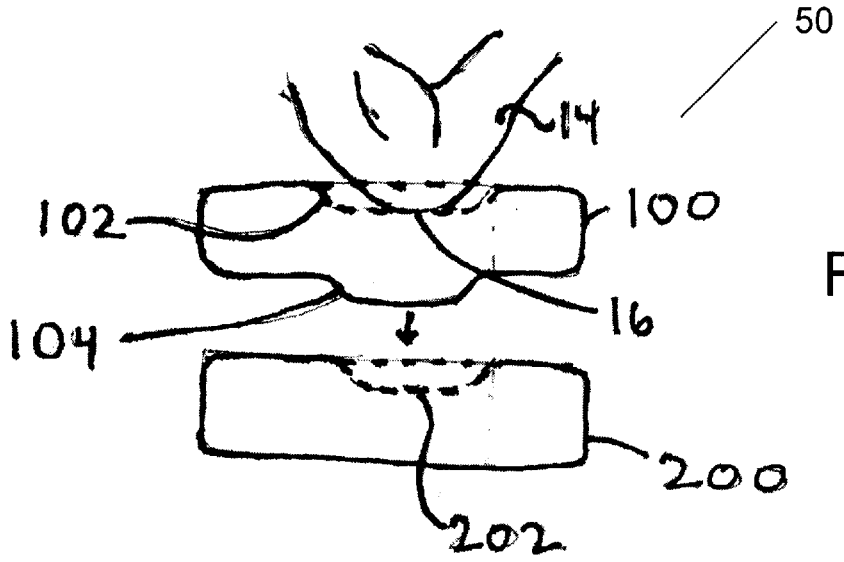
FIGS. 3A and 3B show the tripod support stand of the present invention utilized during the Tripod Modification of FIG. 2.
Figure 3B:
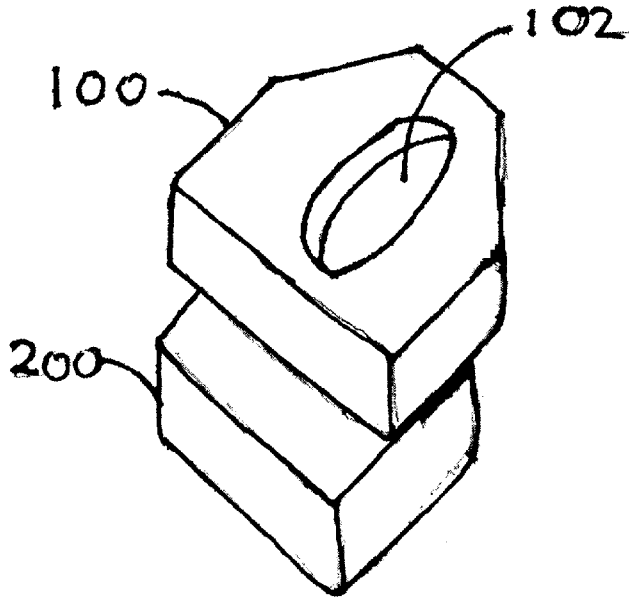
Figure 3C:
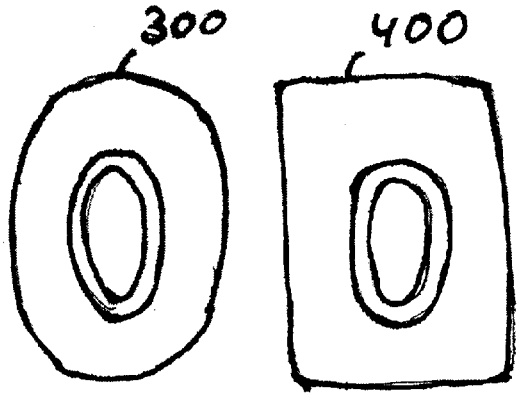
FIG. 3C shows alternate shapes for the resilient pads of the tripod support stand of FIGS. 3A and 3B.

Referring now to FIGS. 3A to 3C the inventive tripod support stand 50 is shown. The tripod support stand 50 includes a first resilient pad 100 of a predetermined thickness with a receiving channel 102 for receiving the elbow 16 and a substantially flat bottom area having an extruded area 104 positioned to align with the receiving channel 102. The first resilient pad 100 is preferably constructed from a thick resilient material of sufficient strength to support substantial weight that may be applied to the support stand 50 via the elbow 16 with minimal deformation while maintaining the comfort of the staff member 10. An example of such resilient material is at least one layer of dense foam coated with a polyurethane compound. The geometric shape of the first resilient pad 100 is illustrated as being trapezoidal, but any geometric shape such as oval shape 300 and square shape 400 as shown in FIG. 3C may be used without departing from the spirit of the invention.

In some cases during application of the tripod modification, particularly when the EDP 12 is larger than the staff member 10, the staff member 10 may be unable to bring the elbow 16 into contact with the floor. In other cases, a staff member who is maintaining the tripod modification for an extended period of time may tire and rest his or her weight on the EDP 12. The tripod support stand 50 advantageously extends the elbow 16 so that contact with the floor surface may be accomplished via the first resilient pad 100, and so that the staff member 10 may be comfortably elevated over the EDP 12. However, in many cases the height of the first resilient pad 100 may be insufficient to accomplish the above-described purpose.

In the preferred embodiment of the present invention, a second resilient pad 200 is provided to releasably attach to the first resilient pad 100 to thereby elevate it above the floor. The second resilient pad 200 includes a receiving indentation 202 generally shaped and postioned to align with, and receive the extruded area 104 of the first resilient pad 100. When the first and second resilient pads 100, 200 come into contact and pressure is applied into the receiving channel 102 by the staff member's elbow 16, the extruded area 104 enters the receiving indentation 202 and creates a vacuum seal releasably attaching the first resilient pad 100 to the second resilient pad 200. After utilization, the first and second resilient pads 100, 200 may then be detached from one another with relative ease by pulling them apart to break the vacuum seal between the extruded area 104 and the receiving indentation 202.

A bottom area of the second resilient pad 200 may optionally be configured to provide limited movement on contact with a floor surface to facilitate potentially necessary movement of the staff member 10 during the tripod stand utilization. For example, the bottom area of the second resilient pad may be coated with a non-skid material such as rubber.

The method of utilization of the tripod support stand 50 is very simple. When the staff member 10 places the EDP 12 into the tripod modification position, a second staff member (not shown) places the tripod support stand 50 under the elbow 16 of the staff member 10 such that the elbow 16 enters the receiving channel 102. If necessary, the second staff member adds the second resilient pad 200 under the first resilient pad 100 such that the resilient pads 100, 200 releasably attach to one another via a vacuum seal between the extruded area 102 and the receiving indentation 202 through the pressure of the elbow 16 in the receiving channel 102. Thus, addition of the second resilient pad 200 elevates the position of the tripod support stand 50, and thus the elbow 16, above the floor surface.

Thus, while there have shown and described and pointed out fundamental novel features of the invention as applied to preferred embodiments thereof, it will be understood that various omissions and substitutions and changes in the form and details of the devices and methods illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

I claim:

1. An apparatus for assisting a first person in maintaining a safe restraining hold on a second person, wherein the first person initiates the restraining hold by manipulating the second person into a face-down prone position onto a floor surface, such that the first person is disposed along and above the second person so as to substantially restrain the second person from movement, wherein the first person completes the restraining hold when the first person's weight is distributed between the first person's knees and the first person's elbow and wherein the first persons elbow is proximal to a corresponding arm of the second person, said apparatus comprising:

a first resilient pad, said first resilient pad having a first upper surface comprising a generally centrally positioned receiving channel for receiving the first person's elbow and a first bottom surface comprising an extruded area generally postioned to align with said receiving channel; and a second resilient pad positioned under said first resilient pad, said second resilient pad having a second upper surface comprising a receiving indentation, positioned to align with and receive said extruded area when said first resilient pad is placed above said second resilient pad, so that when the restraining hold is completed by the first person and a third person places said first and second resilient pads between the first person's elbow and the floor surface, the first person's elbow is guided into and applies pressure to said receiving channel thereby causing a releasable vacuum seal to form between said extruded area and said receiving indentation thereby releasably attaching said first resilient pad to said second resilient pad to form a tripod stand assembly such that:

said first resilient pad comfortably supports the first person's weight that is distributed to the first person's elbow so that the first person may comfortably maintain the restraining hold for an extended period of time, and the first person is elevated above said second person to a sufficient degree so as to reduce a risk of positional asphyxiation and other discomfort to the second person during the restraining hold.

2. The apparatus of claim 1, wherein at least one of said first and second resilient pads is composed of at least one layer of dense foam coated with a polyurethane compound.

3. The apparatus of claim 1, wherein said second resilient pad is substantially identical to said first resilient pad, wherein a second resilient pad receiving channel is configured to form a vacuum seal with said extruded are of said first resilient pad when said first resilient pad is placed over said second resilient pad and pressure is applied to said first resilient pad receiving channel.

4. The apparatus of claim 1, wherein said second resilient pad comprises a second bottom surface configured to reduce horizontal mobility of said second resilient pad along a floor surface.

5. A method for assisting a first person in maintaining a safe restraining hold on a second person, comprising the steps of:

(a) initiating, by the first person, the restraining hold by manipulating the second person into a face-down prone position onto a floor surface, such that the first person is disposed along and above the second person so as to substantially restrain the second person from movement;

(b) completing, by the first person, the restraining hold when the first person's weight is distributed between the first person's knees and the first person's elbow and wherein the first persons elbow is proximal to a corresponding arm of the second person;

(c) providing an elbow support apparatus, said apparatus comprising:

a first resilient pad, said first resilient pad having a first upper surface comprising a generally centrally positioned receiving channel for receiving the first person's elbow and a first bottom surface comprising an extruded area generally postioned to align with said receiving channel; and a second resilient pad positioned under said first resilient pad, said second resilient pad having a second upper surface comprising a receiving indentation, positioned to align with and receive said extruded area when said first resilient pad is placed above said second resilient pad; and (d) when the restraining hold is completed by the first person, placing, by a third person, said support apparatus between the first person's elbow and the floor surface, such that the first person's elbow is guided into and applies pressure to said receiving channel thereby causing a releasable vacuum seal to form between said extruded area and said receiving indentation, thereby releasably attaching said first resilient pad to said second resilient pad so that:

said elbow support apparatus comfortably supports the first person's weight that is distributed to the first person's elbow to enable the first person to comfortably maintain the restraining hold for an extended period of time, and the first person is elevated above said second person to a sufficient degree so as to reduce a risk of positional asphyxiation and other discomfort to the second person during the restraining hold.

* * * * *